US007837283B2

(12) United States Patent
Goto et al.

(10) Patent No.: US 7,837,283 B2
(45) Date of Patent: Nov. 23, 2010

(54) INK JET PRINTING APPARATUS AND INK JET PRINTING METHOD

(75) Inventors: Eri Goto, Yokohama (JP); Tsuyoshi Shibata, Yokohama (JP); Hiromitsu Yamaguchi, Yokohama (JP); Takashi Ochiai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 491 days.

(21) Appl. No.: 11/091,432

(22) Filed: Mar. 29, 2005

(65) Prior Publication Data

US 2005/0219279 A1 Oct. 6, 2005

(30) Foreign Application Priority Data

Mar. 31, 2004 (JP) ..... 2004-107752

(51) Int. Cl.
*B41J 29/38* (2006.01)
*B41J 2/01* (2006.01)

(52) U.S. Cl. ..... 347/5; 347/14; 347/104

(58) Field of Classification Search ..... 347/5, 347/14, 104
See application file for complete search history.

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,723,129 | A | 2/1988 | Endo et al. | |
| 4,740,796 | A | 4/1988 | Endo et al. | |
| 6,497,467 | B2 | 12/2002 | Suwa et al. | |
| 6,986,561 | B2 | 1/2006 | Takeuchi | |
| 2002/0054182 | A1 * | 5/2002 | Yazawa | 347/23 |
| 2002/0118236 | A1 * | 8/2002 | Uetsuki | 347/7 |
| 2003/0048326 | A1 | 3/2003 | Yamasaki et al. | |
| 2003/0067508 | A1 | 4/2003 | Mizutani et al. | |
| 2004/0212649 | A1 * | 10/2004 | Ouchi | 347/16 |

FOREIGN PATENT DOCUMENTS

| | | |
|---|---|---|
| JP | 59-123670 | 7/1984 |
| JP | 59-138461 | 8/1984 |
| JP | 2-102079 | 4/1990 |
| JP | 2-289355 | 11/1990 |
| JP | 7-013397 | 1/1995 |
| JP | 07-052465 | 2/1995 |
| JP | 7-276781 | 10/1995 |
| JP | 08-025693 | 1/1996 |

(Continued)

*Primary Examiner*—Matthew Luu
*Assistant Examiner*—Jannelle M Lebron
(74) *Attorney, Agent, or Firm*—Fitzpatrick, Cella, Harper & Scinto

(57) ABSTRACT

In a multipass printing system, a quality image is printed even when the number of passes is reduced to increase a printing speed. For this purpose, in a multipass printing system which repetitively alternates a printing scan, which causes the print head to eject ink from the nozzles as it moves in the main scan direction, and a feeding operation, which feeds a print medium in a sub scan direction, the feed distance of the print medium is set according to a density of an image being printed on the print medium.

2 Claims, 18 Drawing Sheets

FOREIGN PATENT DOCUMENTS

| | | |
|---|---|---|
| JP | 9-239966 | 9/1997 |
| JP | 2002-036524 | 2/2002 |
| JP | 2003-025555 | 1/2003 |
| JP | 2003-145775 | 5/2003 |
| JP | 2004-025684 | 1/2004 |
| JP | 2004-050498 | 2/2004 |

* cited by examiner

INK JET PRINTING APPARATUS AND INK JET PRINTING METHOD

BACKGROUND OF THE INVENTION

1. Field of the Invention

The present invention relates to a serial scan type ink jet printing apparatus and method.

2. Description of the Related Art

In a serial scan type ink jet printing apparatus of recent years, there are growing demands for faster printing speed. As a method for increasing the printing speed, it is effective to reduce the number of passes in a multipass printing method that is used to enhance a quality of printed images. The number of print passes refers to the number of scans that a print head is required to perform to have one line of image printed. Normally, the ink jet print head is mounted on a carriage which is reciprocally moved in a main scan direction that crosses a sub-scan direction in which a print medium is fed. The ink jet print head has a column of ink ejection openings arrayed in the sub-scan direction. These openings form a plurality of nozzles. An image is progressively formed on a print medium by repetitively alternating a printing scan, by which the print head ejects ink as it travels in the main scan direction, and a feeding operation, by which the print medium is fed a predetermined distance in the sub-scan direction (also referred to as a "paper feed").

In the multipass printing method, since the print head has a predetermined number of ink ejection openings or nozzles the more the number of passes, the smaller the print medium feed distance (paper feed distance) for each pass will be. Conversely, as the number of passes is reduced, the paper feed distance for each pass increases. Therefore, the printing speed can be increased by reducing the number of passes. For example, when a 4-pass printing is changed to 2-pass printing, the printing speed theoretically increases two times. A 1-pass printing, if applicable, can further enhance the printing speed. That is, as the number of passes decreases, the number of scans that the carriage must perform to complete the printing over a predetermined print area (e.g., print surface of one sheet of print medium) decreases and the paper feed distance per pass increases. This in turn shortens the time required to print one sheet of print medium.

The print head having a plurality of ink ejection nozzles performs a printing scan in a main scan direction almost perpendicular to a direction in which the nozzles are arrayed. Thus, when for example a 2-pass printing is performed, a linear high density area is formed at a boundary between a strip area printed by a first printing scan and a strip area printed by a second printing scan.

In the 2-pass printing, since each band of area is printed by two scans, a duty of ink (relative number of ink dots) applied to the print medium in one scan is about two times greater than that of a 4-pass printing which prints one band of area in four scans. Thus, in a print medium such as plain paper, in which ink dots easily spread, a boundary portion between adjoining band areas which is applied a greater number of ink dots than in other areas has an increased risk of ink spread, although its likelihood varies depending on an ink property. As a result, a dark line (high density line) shows up, degrading the quality of a printed image.

A variety of methods have been proposed to eliminate the above-described dark lines at boundary portions and thereby enhance the quality of printed images (e.g., Japanese Patent Application Laid-open Nos. 2002-36524, 8-25693 (1996) and 7-52465 (1995)).

Japanese Patent Application Laid-open No. 2002-36524 describes a method for the serial scan system which prevents dark lines from being produced at boundary portions between bands of print area when the print head repetitively performs a printing scan, one band at a time, in the main scan direction. That is, in a printing scan that prints on the boundary portion, print data corresponding to an area close to the boundary portion is thinned according to a count value of ink dots formed in that area close to the boundary portion. By thinning the ink dots formed in the area close to the boundary portion, the formation of dark lines can be prevented.

Japanese Patent Application Laid-open No. 8-25693 (1996) describes a method for the serial scan system which makes less noticeable dark lines that are formed at the boundary portions between bands of print area when the print head repetitively performs a printing scan, one band at a time, in the main scan direction. That is, in a 1-pass printing, an image printed in a preceding scan and an image to be printed in the next scan are partly overlapped and a random mask pattern is used for the overlapping image area so that the two scans complement each other in forming ink dots in the overlapping area.

Japanese Patent Application Laid-open No. 7-52465 (1995) describes a method for a serial scan type multipass printing system which makes dark lines formed at the boundary portions less noticeable by randomly setting a paper feed distance using a random number to randomize a dark line occurrence frequency.

Although they can be applied where dark lines are always formed in the boundary portions in image areas, the conventional methods, however, cannot eliminate white lines that are caused by a paper feed accuracy problem and by a phenomenon called an "end nozzle dot deflection." The "end nozzle dot deflection" is a phenomenon in which ink droplets ejected from end nozzles of a nozzle column in the print head land at positions deviated toward the center of the nozzle column (see Japanese Patent Application Laid-open No. 2003-145775). That is, as ink droplets are ejected from the nozzles, the surrounding air is carried away by the droplets, reducing the pressure of a space near the nozzle face of the print head relative to the surrounding. Thus, the air near the print head flows toward the reduced pressure space. This air flow draws ink droplets, particularly those ejected from the end nozzles of the nozzle column, toward the center of the nozzle column, with the result that the ink droplets land at positions deviated toward the center of the print head This process occurs in the so-called end nozzle dot deflection.

FIG. 1 is an explanatory diagram showing landing positions of ink droplets when no end nozzle dot deflection results In the first scan in FIG. 1, the print head H ejects ink droplets from its nozzles N1-N8 as it moves in the main scan direction indicated by arrow X, to have the ink droplets land on one band of area in the print medium S. Then, the print medium S is fed a distance equal to the width of one band in the sub-scan direction indicated by arrow Y. In FIG. 1, the print head H is depicted as if it was moving in a direction opposite the arrow Y relative to the print medium S. In the second scan the print head H, as in the first scan, ejects ink droplets from its nozzles N1-N8 as it travels in the main scan direction of arrow X, to have the ink droplets land on another band of area in the print medium S. In the case of FIG. 1, the end nozzle dot deflection has not occurred and the ink droplets have landed at intended positions. Therefore, no dark or white line is formed at the boundary portion P in the image area.

However, if an end nozzle dot deflection should occur in which the landing positions of the ink droplets ejected from the end nozzles N1, N2, N6-N8 deviate toward the center of the print head H, the boundary portion P appears as a white line and is easily noticed. Depending on the print head used, the landing positions of ink droplets ejected from end nozzles may deviate toward the outside of the print head. In that case, the boundary portion appears as a dark line. These white or dark lines vary depending on the kind of print medium. In the case of a print medium in which ink easily spreads, such as plain paper, the boundary portions are likely to appear as dark lines.

In the 2-pass printing, since the duty of ink applied to the print medium in one pass is larger than in the 4-pass printing as described above, the amount of the end nozzle dot deflection is larger than that of the 4-pass printing. Thus, when the 2-pass printing is performed on a print medium in which ink dots hardly spread, such as photograph paper, there is an increased risk that the greater end nozzle dot deflection than that of the 4-pass printing can result in more noticeable white lines at the boundary portions, significantly degrading the quality of printed images. If the white or dark lines at the boundary portions are to be made less noticeable by correcting print data corresponding to the end nozzles, as in the conventional techniques described above, the white or dark boundary lines may not be made less noticeable to an expected level and remain to show up. This phenomenon becomes conspicuous as the ink droplets become small (to less than 2.8 pl), a significant hindrance to printing high quality images such as photographs and graphics.

SUMMARY OF THE INVENTION

The present invention can overcome the problems described above and can provide an ink jet printing apparatus and an ink jet printing method for a multipass printing system which can print high-quality images even if the printing speed is increased by reducing the number of passes.

In a first aspect of the present invention, there is provided an ink jet printing apparatus for printing an image on a print medium by using a print head capable of ejecting ink from a plurality of nozzles arrayed in a line, the ink jet printing apparatus comprising:

moving means for moving the print head in a main scan direction;

feeding means for feeding the print medium in a sub-scan direction crossing the main scan direction;

control means for controlling the moving means and the feeding means to repetitively alternate a printing scan and a feeding operation, the printing scan being adapted to cause the print head to eject ink from the nozzles as it is moved in the main scan direction, the feeding operation being adapted to feed the print medium in the sub-scan direction; and feed distance setting means for setting a feed distance over which the print medium is to be fed by the feeding means, according to a density of the image being printed on the print medium.

In a second aspect of the present invention, there is provided an ink jet printing apparatus for printing an image on a print medium by using a print head capable of ejecting ink from a plurality of nozzles arrayed in a line, the ink jet printing apparatus comprising:

moving means for moving the print head in a main scan direction;

feeding means for feeding the print medium in a sub-scan direction crossing the main scan direction;

control means for controlling the moving means and the feeding means to repetitively alternate a printing scan and a feeding operation, the printing scan being adapted to cause the print head to eject ink from the nozzles as it is moved in the main scan direction, the feeding operation being adapted to feed the print medium in the sub-scan direction; and feed distance setting means foe setting a feed distance over which the print medium is to be fed by the feeding means, according to a kind of the print medium.

In a third aspect of the present invention, there is provided an ink jet printing apparatus for printing an image on a print medium by using a print head capable of ejecting ink from a plurality of nozzles arrayed in a line, the ink jet printing apparatus comprising:

moving means for moving the print head in a main scan direction;

feeding means for feeding the print medium in a sub-scan direction crossing the main scan direction;

control means for controlling the moving means and the feeding means to repetitively alternate a printing scan and a feeding operation, the printing scan being adapted to cause the print head to eject ink from the nozzles as it is moved in the main scan direction, the feeding operation being adapted to feed the print medium in the sub-scan direction; and feed distance setting means for setting a feed distance over which the print medium is to be fed by the feeding means, according to an amount of deviation of landing position of ink droplet ejected from nozzle situated at an end of the nozzle line.

In a fourth aspect of the present invention, there is provided an ink jet printing method for printing an image on a print medium by using a print head capable of ejecting ink from a plurality of nozzles arrayed in a line, the ink jet printing method comprising the steps of:

repetitively alternating a printing scan and a feeding operation to form an image successively on the print medium, the printing scan being adapted to cause the print head to eject ink from the nozzles as it is moved in the main scan direction, the feeding operation being adapted to feed the print medium in the sub-scan direction; and setting a feed distance of the print medium according to a density of an image being printed on the print medium.

In a fifth aspect of the present invention, there is provided an ink jet printing method for printing an image on a print medium by using a print head capable of ejecting ink from a plurality of nozzles arrayed in a line, the ink jet printing method comprising the steps of:

repetitively alternating a printing scan and a feeding operation to form an image successively on the print medium, the printing scan being adapted to cause the print head to eject ink from the nozzles as it is moved in the main scan direction, the feeding operation being adapted to feed the print medium in the sub-scan direction; and setting a feed distance of the print medium according to a kind of the print medium.

In a sixth aspect of the present invention, there is provided an ink jet printing method for printing an image on a print medium by using a print head capable of ejecting ink from a plurality of nozzles arrayed in a column, the ink jet printing method comprising the steps of:

repetitively alternating a printing scan and a feeding operation to form an image successively on the print medium, the printing scan being adapted to cause the print head to elect ink from the nozzles as it is moved in the main scan direction, the feeding operation being adapted to feed the print medium in the sub-scan direction; and setting a feed distance of the print medium according to an amount of deviation of landing position of ink droplet ejected from the nozzle situated at an end of the nozzle line.

With this invention, even when the printing speed is increased by reducing the number of passes, it is possible to print high-quality images with no noticeable boundary lines showing up, by setting a print medium feed distance according to a state of image being printed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of this invention will be described by referring to the accompanying drawings.

First Embodiment

Figure 5:
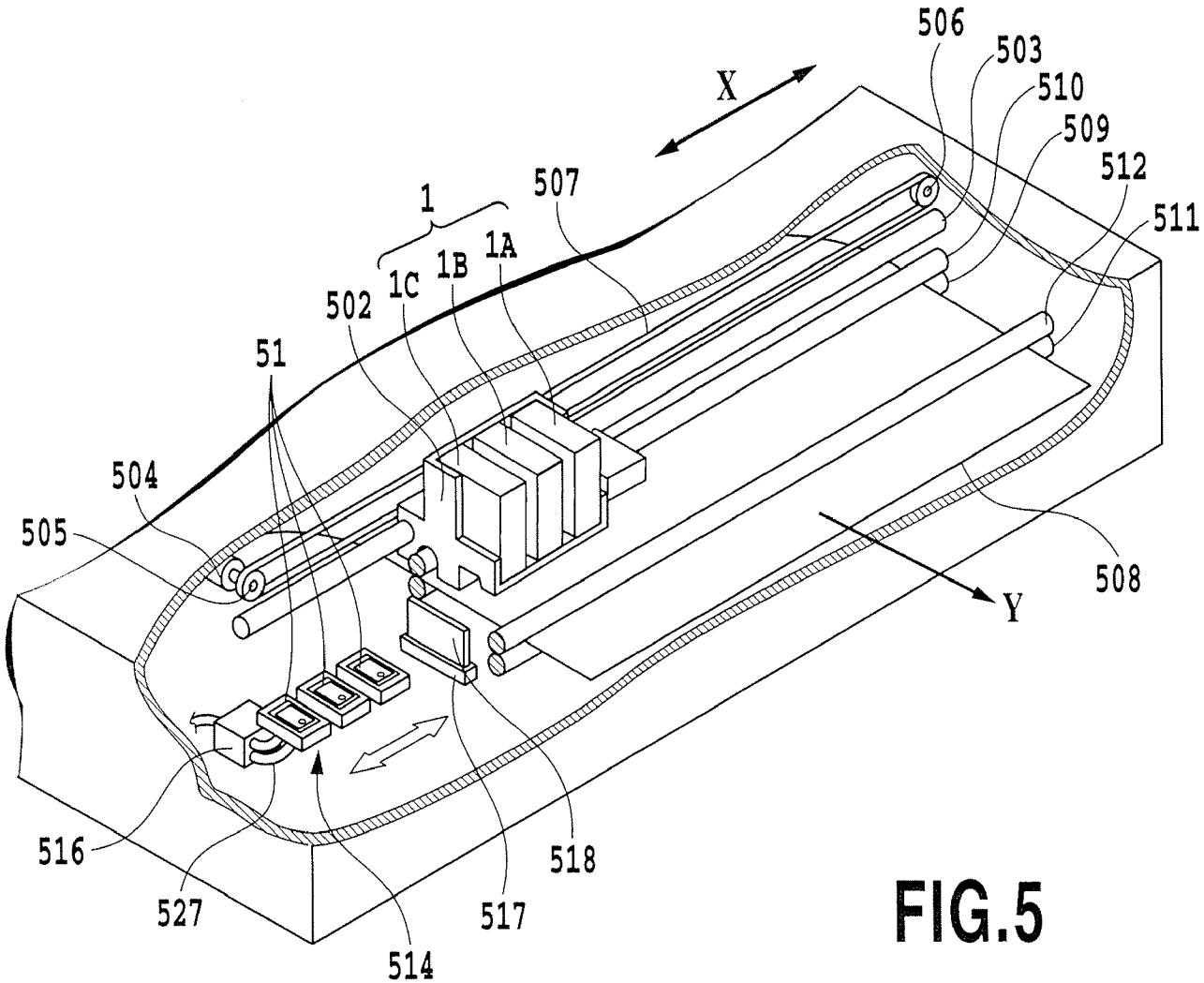
FIG. 5 is a partly cutaway perspective view showing an outline construction of an ink jet printing apparatus as a first embodiment of this invention.

FIG. 5 is a schematic perspective view showing a construction of an essential portion of an ink jet printing apparatus that can apply the present invention. The printing apparatus of this example is a serial scan type ink jet printing apparatus using a plurality of print heads.

In FIG. 5, a plurality (three) of head cartridges 1 (1A, 1B, 1C) are replaceably mounted on a carriage 502. Each of the cartridges 1A, B, 1C comprises a print head capable of ejecting ink, an ink tank accommodating an ink to be supplied to the print head, and a connector to receive a signal for driving the print head. Each print head may be formed integral with an ink tank to form a head cartridge 1 or may be formed separate from the ink tank. In the following, the head cartridges 1A, 1B, 1C are also referred to as print heads. The printing means 1A, 1B, 1C in general or one of them is also referred to as a printing means 1 or print head 1.

A plurality of print heads 1 eject different color inks and the ink tanks for supplying inks accommodate different inks, such as cyan, magenta and yellow inks. Each print head 1 is replaceably mounted on the carriage 502 and positioned there. The carriage 502 is provided with a connector holder (electric connecting portion) to be connected with the connectors on the print head 1 side. Through these connectors drive signals are transmitted to respective print head 1. The carriage 502 is guided along a guide shaft 503 installed in the printing apparatus so that the carriage can be moved in the main scan direction of arrow X. The carriage 502 is fixed to a timing belt 507 stretched between a motor pulley 505 and a follower pulley 506 and is controlled by a main scan motor 504 driving the motor pulley 505. A print medium 508, such as paper and plastic thin plate, is fed in the sub-scan direction of arrow Y by the rotation of two pairs of transport rollers 509, 510 and 511, 512 through a position (printing portion) where it faces a nozzle surface (a surface formed with ejection openings) of the print head 1. In the printing portion, the print medium 508 is supported at its back on a platen (not shown) so that the print medium in the printing portion forms a flat print surface. With the print head 1 mounted on the carriage 502, the nozzle surface of the print head protrudes down from the carriage 502 and faces the print surface of the print medium 508 situated between the two pairs of transport rollers 509, 510 and 511, 512.

The print head 1 is provided with a means to generate energy for ejecting ink from the nozzles. In this example, the print head has electrothermal transducers that generate a thermal energy to eject ink. That is, the thermal energy produced by the electrothermal transducers causes a film boiling, forming bubbles in ink. The bubbles as they expand and contract produce pressure changes in ink to cause ink droplets from being ejected from the nozzles.

Figure 6:
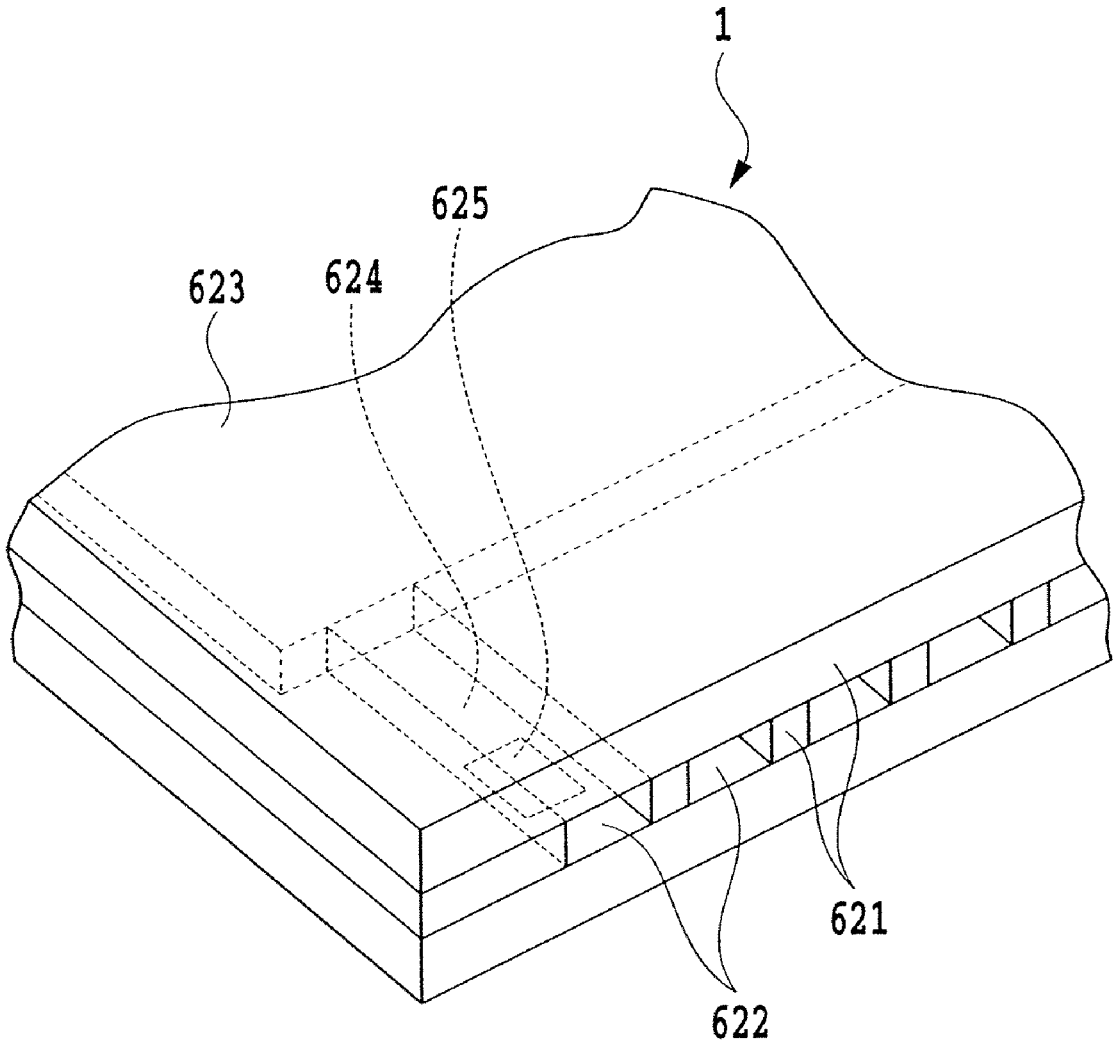
FIG. 6 is a schematic perspective view showing a construction of an essential portion of the print head of FIG. 5.

FIG. 6 is a schematic perspective view showing an ink election portion or nozzles in the print head 1 of the above construction.

In FIG. 6, a nozzle surface 621 faces the print medium 508 with a predetermined gap therebetween (about 0.5-2 mm). The nozzle surface 621 is formed with a plurality (here 512) of ink ejection openings or nozzles 622 at a predetermined pitch (here 1200 dpi). The nozzles 622 are communicated with a common ink chamber 623 through individual flow paths 624. In a wall of each flow path 624 electrothermal transducer (heater) 625 for generating ink ejection energy is arranged. The print head 1 of this example is mounted on the carriage 502 so that the nozzles 622 are arrayed in a direction that crosses the scan direction of the carriage 502. By energizing the electrothermal transducers 625 according to an image signal or ejection signal, it is possible to cause a film boiling in ink in the flow paths 624 in which the electrothermal transducers 625 of interest are situated, thereby ejecting ink droplets from the nozzles 622 by the generated pressure.

Reference numeral 514 denotes an ejection performance recovery unit which has caps 51 one for each print head 1, a suction pump 516 connected to the inside of the caps 51 through pipes 527, and a wiper 517 having a blade 518. The caps 51 cap the nozzle surfaces 621 of the print heads 1 when the corresponding print heads 1 move to positions directly above the caps. With the caps closed, activating the suction pump 516 to apply a suction force to the interior of the caps 51 causes ink not contributing to printing to be sucked out of the nozzles 622 of the print heads 1, thus maintaining the ink ejection performance of the print heads 1 in good condition. Also by causing ink not contributing to printing to be ejected from the nozzles 622 toward the inside of the caps 51 (preliminary ejection), it is possible to keep the ink ejection performance of the print heads 1 in good condition. The blade 518 of the wiper 517 wipes the nozzle surfaces 621 of the print heads 1 to clear the nozzle surfaces of adhering matters.

Figure 7:
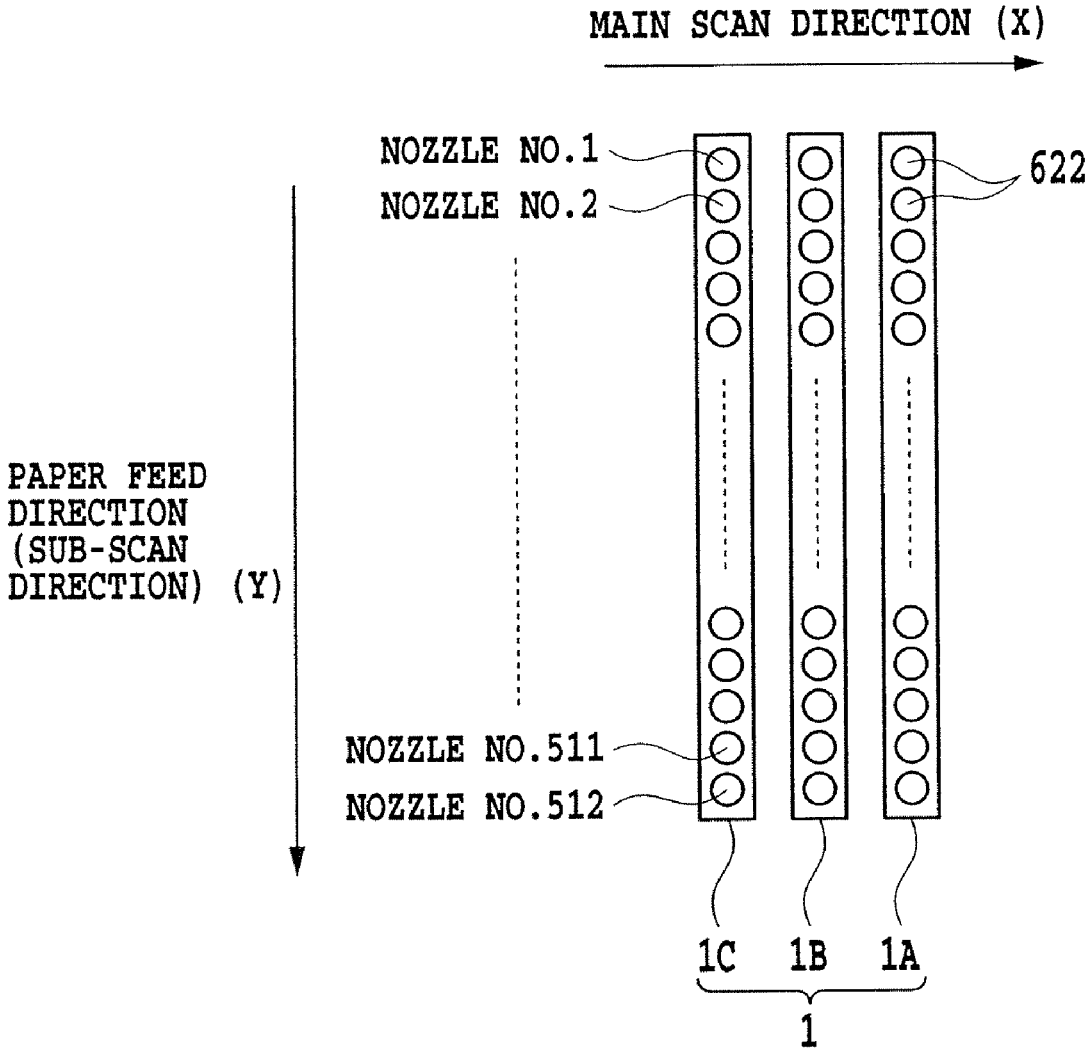
FIG. 7 is an explanatory diagram showing a nozzle arrangement in the print head of FIG. 5.

FIG. 7 is an explanatory diagram showing an arrangement of the print heads 1 (1A, 1B, 1C), which are mounted on the carriage 502 so that their 512 nozzles 622 (nozzle No. 1-512) are arrayed in the sub-scan direction. The print head 1A ejects a yellow ink, the print head 1B ejects a magenta ink, and the print head 1C ejects a cyan ink.

Figure 8:
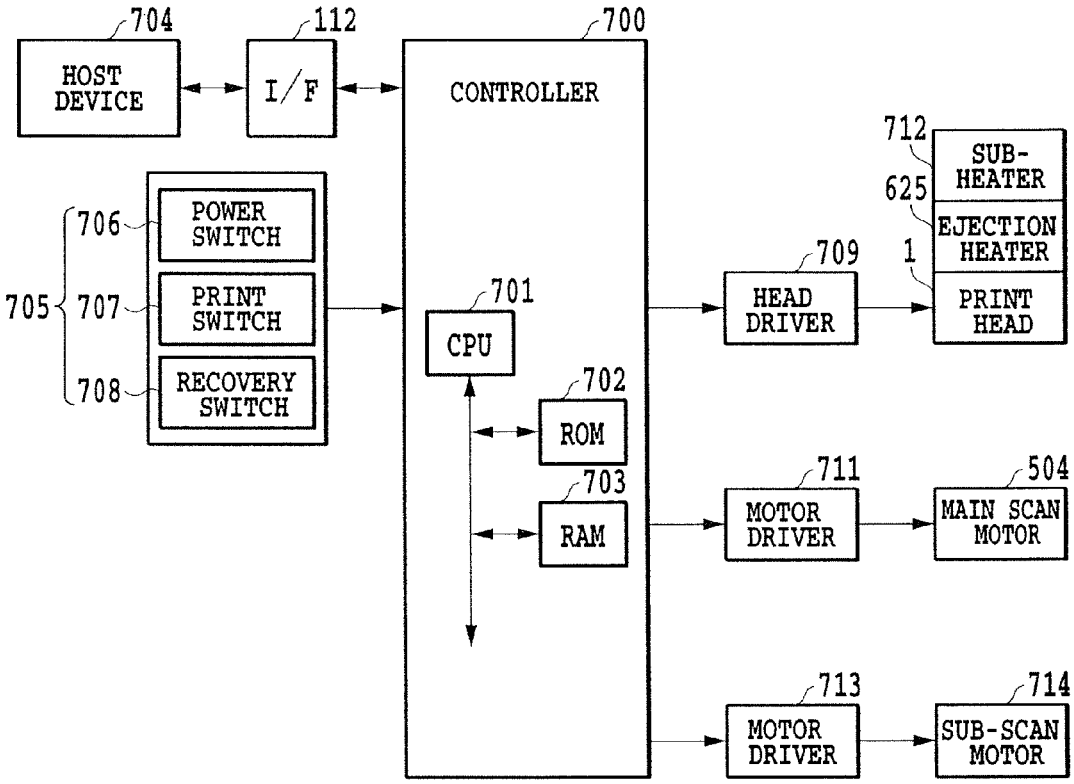
FIG. 8 illustrates a block diagram of a control system in the ink jet printing apparatus of FIG. 5.

FIG. 8 is a block diagram showing an example configuration of a control system in the ink jet printing apparatus of FIG. 5.

In FIG. 8, a controller 700 is a main control unit which includes, for example, CPU 701 in the form of microcomputer, a ROM 702 storing programs, tables and other fixed data, and a RAM 703 having an area for mapping image data and a work area. A host device 704 is a source of image data and may take the form of a computer that generates data to be printed, such as images and performs processing, or a reader for reading an image. Image data and command and status signals are transferred through an interface (I/F) 112 between the host device 704 and the controller 700.

An operation unit 705 has a group of switches operated by an operator, which includes a power switch 706, a start switch 707 for initiating a printing operation, and a recovery switch 708 for starting the suction recovery operation.

A head driver 709 energizes the ejection heaters (electrothermal transducers) 625 of the print head 1 according to print data. The head driver 709 includes a shift register to match the print data to the positions of the ejection heaters 625 and arrange these information in order, a latch circuit to latch print data at an appropriate timing, a logic circuit element to energize the ejection heaters 625 in synchronism with the drive timing signal, and a timing setting unit to appropriately set a drive timing (ejection timing) to align ink dots with intended landing positions. The print head 1 of this example also has sub-heaters 712 to adjust temperature and thereby stabilize the ink ejection performance. The sub-heaters 712 may be formed on a substrate of the print head at the same time that the ejection heaters 625 are formed, or may be mounted on the print head or head cartridge.

A motor driver 711 drives the main scan motor 504. A sub-scan motor 714 is a drive source to transport the print medium 508 in the sub-scan direction. A motor driver 713 is a driver for the sub-scan motor 714.

Next, an example printing operation will be explained in detail. In this example, a 1-pass printing is performed under the control of the controller 700 as the main control unit by changing the print medium feed distance (paper feed distance) in multiple stages according to the grayscale of an image being printed.

Figure 1:
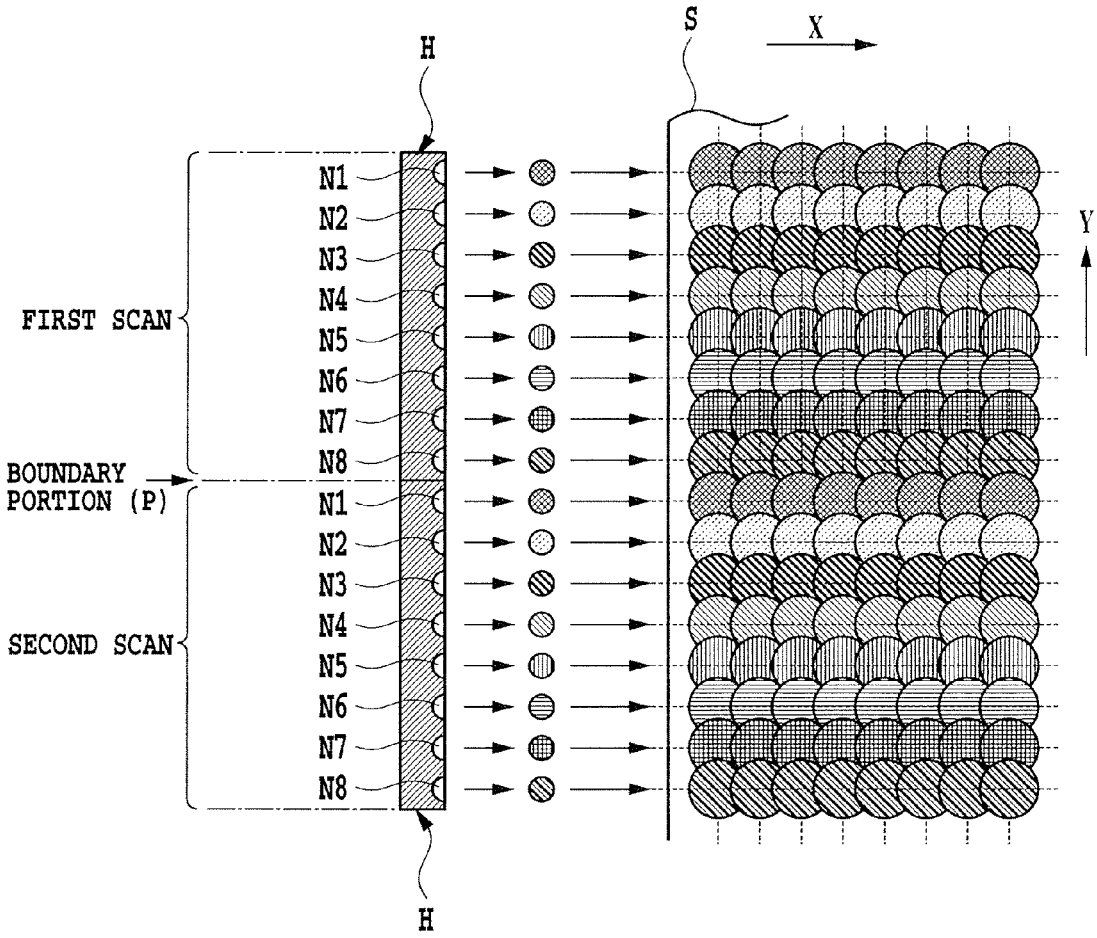
FIG. 1 is an explanatory diagram showing ideal landing positions of ink droplets.
Figure 2:
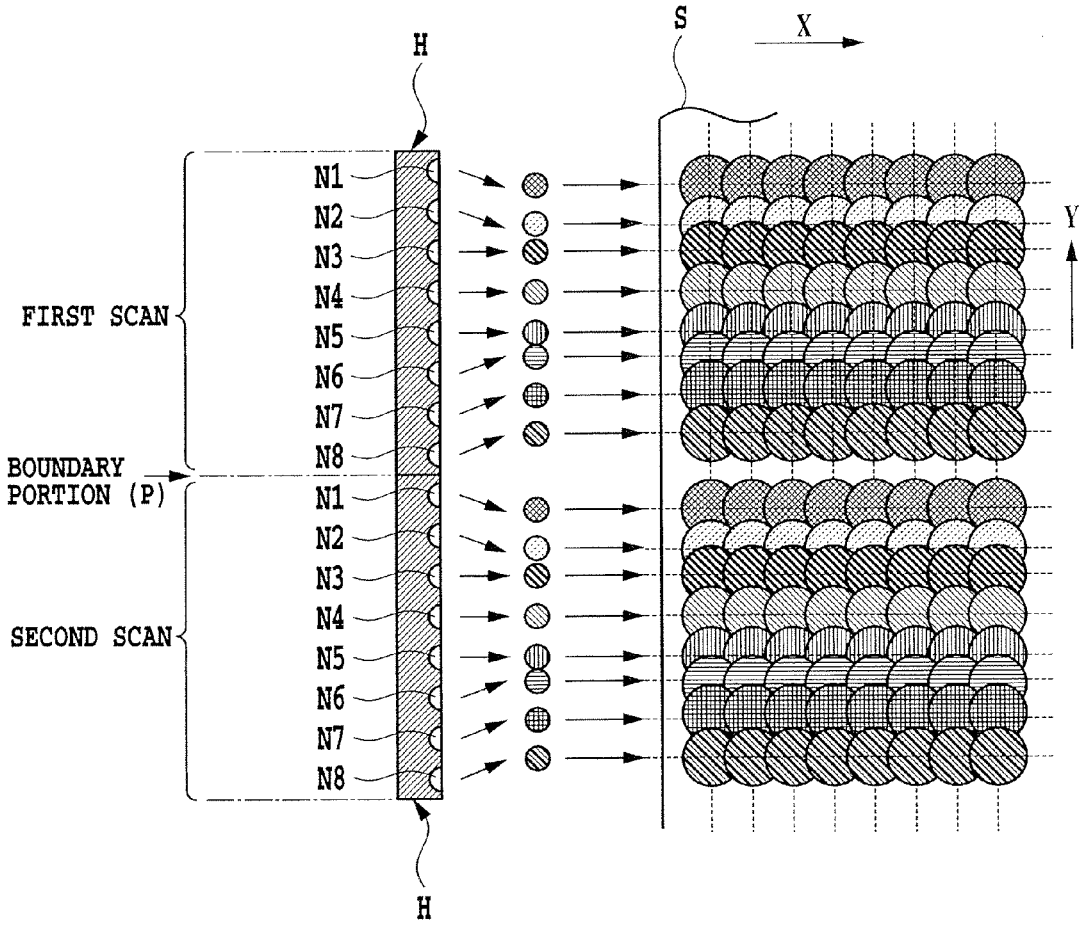
FIG. 2 is an explanatory diagram showing landing positions of ink droplets when an end nozzle dot deflection occurs.
Figure 3:
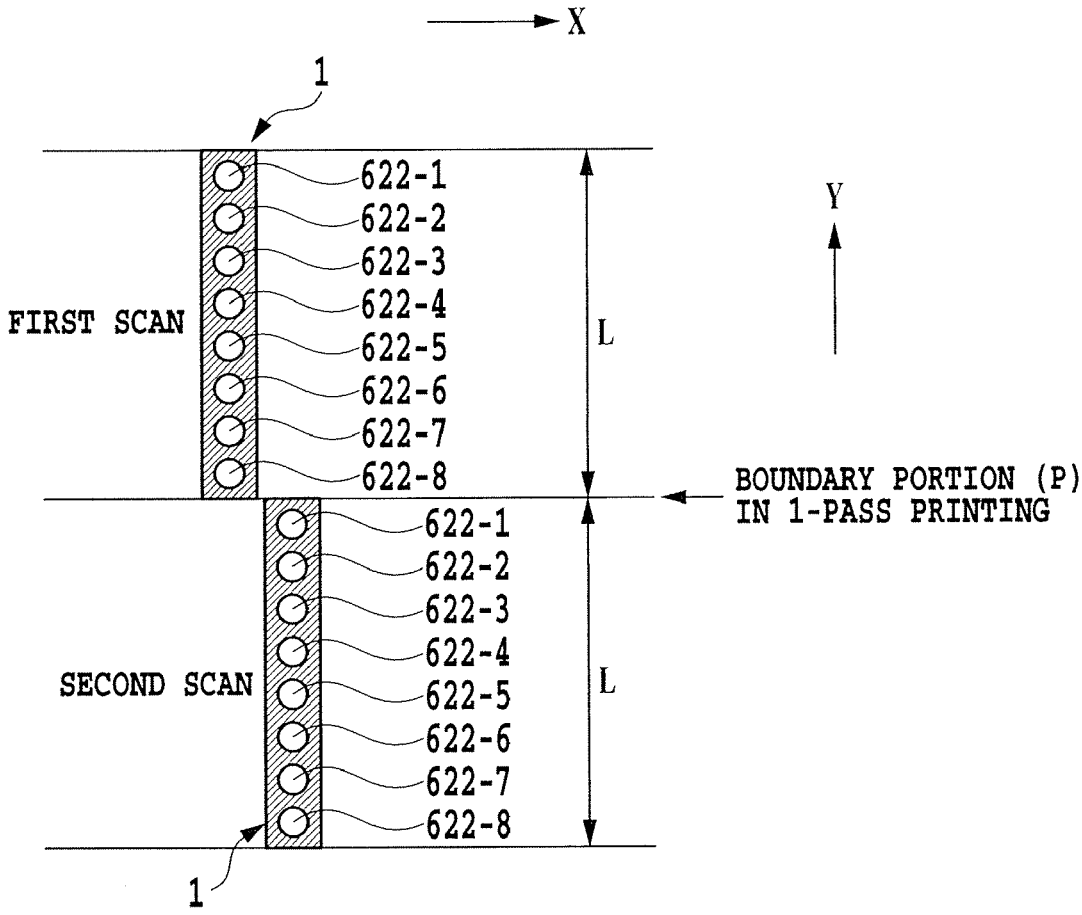
FIG. 3 is an explanatory diagram showing a relation between a 1-pass printing and a boundary portion.

FIG. 3 is an explanatory diagram showing the process of printing an image by the 1-pass printing. In FIG. 3, reference numeral L denotes a normal paper feed distance which is equal to the length of the print head 1. After one band of area has been printed by a first scan of the print head 1, the print medium 508 is fed a distance L in the sub-scan direction. Then, the next band of area is printed by a second scan. In FIG. 3, the print head 1 is depicted as if it was moving in a direction opposite the arrow Y relative to the print medium 508. For ease of explanation, only eight nozzles 622 are shown in the print head 1.

Figure 4:
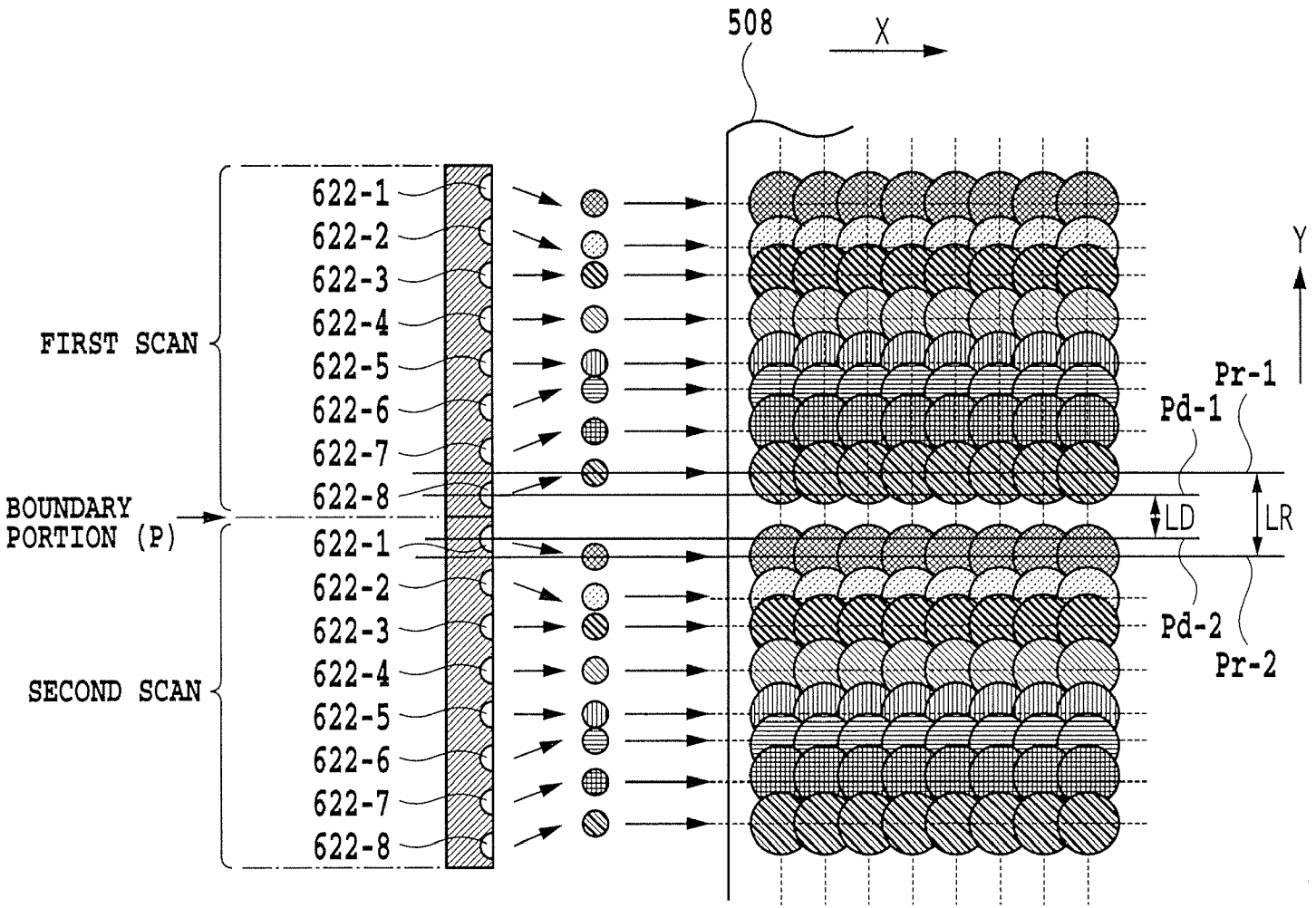
FIG. 4 is an explanatory diagram showing a relation between the ideal landing positions of ink droplets and the landing positions of ink droplets when an end nozzle dot deflection occurs.

FIG. 4 is an explanatory diagram showing how ink droplets land on a print medium when an end nozzle dot deflection occurs with the print head 1, with ink droplets ejected from end nozzles 622-1, 622-2, 622-6 to 622-8 deviating from their intended landing positions. Reference numeral Pr-1 denotes an actual landing position of ink droplets ejected from the end nozzle 622-8 during the first scan, and Pd-1 denotes an intended landing position of these ink droplets. Reference numeral Pr-2 denotes an actual landing position of ink droplets ejected from the end nozzle 622-1 during the second scan, and Pd-2 denotes an intended landing position of these ink droplets. Reference numeral LR denotes a distance between the landing positions Pr-1 and Pr-2, and LD denotes a distance between the landing positions Pd-1 and Pd-2. When $\Delta L=0$, where $\Delta L=LR-LD$, setting the normal paper feed distance L as shown in FIG. 3 does not result in a white or dark line appearing in a boundary portion P. However, when $\Delta L\neq 0$ and if the normal paper feed distance L is set as shown in FIG. 3, a boundary line appears in the boundary portion P as shown in FIG. 4.

The applicant of this invention confirmed a phenomenon in which the difference $\Delta L$ varies according to the print duty (see Japanese Patent Application Laid-open No. 2003-145775). As described above, the end nozzle dot deflection is a phenomenon in which ink droplets ejected from end nozzles situated at the ends of the nozzle column are drawn toward the center of the nozzle column and land on the print medium at positions deviated toward the center of the print head. Thus, the higher the print duty, the stronger the tendency that a pressure in the surrounding of the print head nozzle surface will decrease and the greater the landing position deviations corresponding to the difference $\Delta L$ will become.

Figure 9:
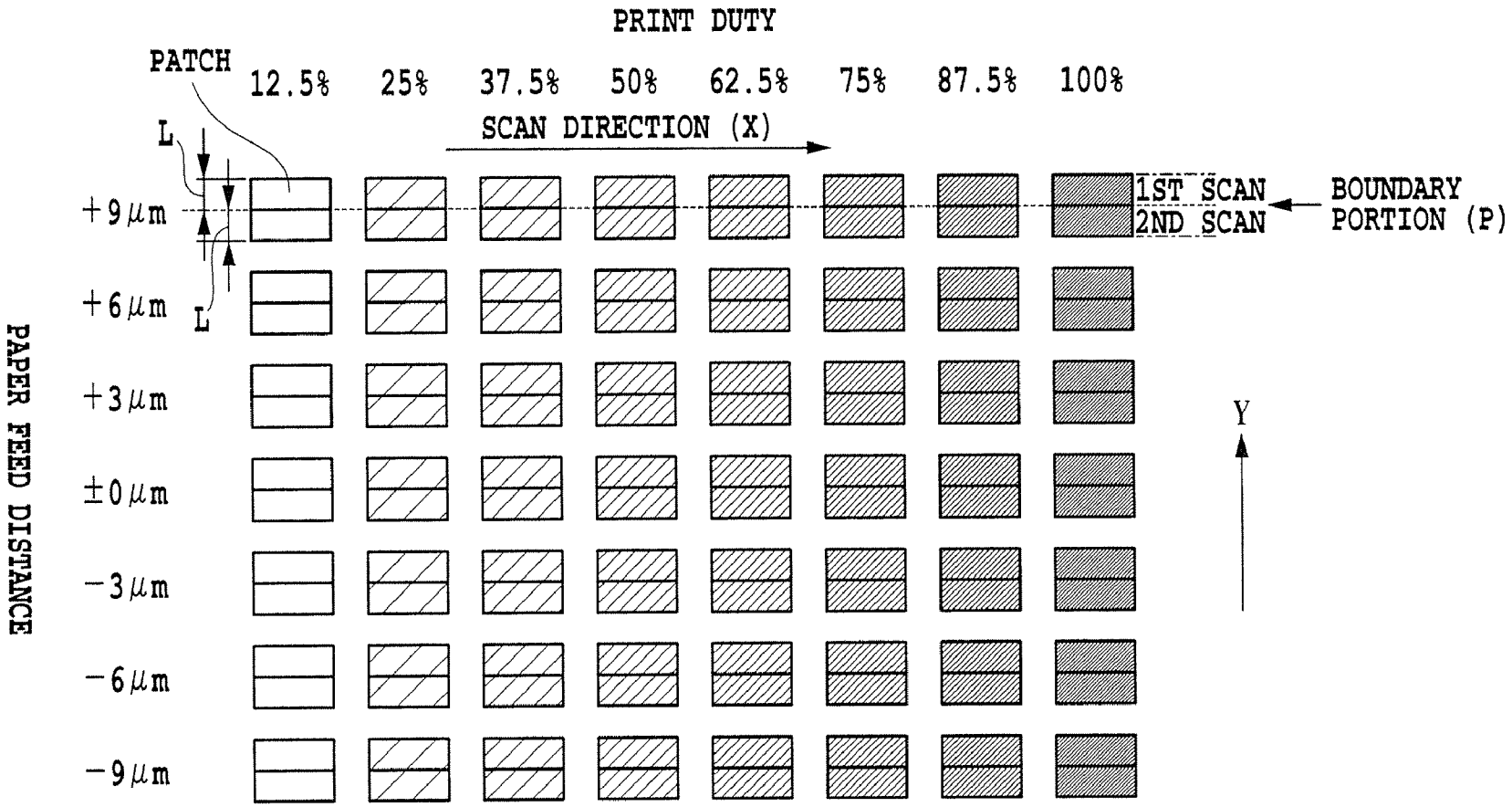
FIG. 9 is an explanatory diagram showing a paper feed distance setting pattern in the first embodiment of this invention.

In this example, as shown in FIG. 9, a plurality of patches corresponding to a plurality of stages of print duty are printed as paper feed distance setting patterns. From the printed patterns, an optimum paper feed distance is determined.

In FIG. 9, a paper feed distance ±0 is equivalent to the normal paper feed distance L (=length of print head 1). In this example, seven stages of paper feed distance (+9, +6, +3, ±0, −3, −6, −9 μm) and eight stages of print duty (12.5, 25, 37.5, 50, 62.5, 75, 87.5, 100%) are considered and a total of 56 (=7×8) patches are printed. The patches printed in one scan are rectangular in shape, with their vertical length set to L, the length of the print head, and their width set to 2 cm. In FIG. 9, eight patches arranged horizontally are printed in two scans by the 1-pass printing using the corresponding paper feed distance. Therefore, when the paper feed distance is correct, these patches printed in two scans are 2 L in their vertical length. For instance, eight patches arranged horizontally in the top row in the figure are first printed in their upper half by the first scan for eight stages of print duty. Then, the print medium is fed the corresponding paper feed distance (+9 μm) in the sub-scan direction, after which the lower half of these patches is printed by the second scan for eight stages of print duty. The paper feed distance (+9 μm) is 9 μm longer than the normal paper feed distance L.

From the printed result of these patches, a selection is made of a paper feed distance for each print duty, for which a boundary line in the boundary portion P between the first scan and the second scan is least noticeable. The selected paper feed distance is set as an optimal paper feed distance for each print duty. Considering print head manufacturing variations and paper feed accuracy variations, printing the paper feed distance setting patterns as shown in FIG. 9 in every printing apparatus is very effective in setting an optimal paper feed distance for each printing apparatus. Further, since the boundary line appears differently depending on the kind of print medium, it is preferred that the paper feed distance setting patterns be printed on a desired print medium. To determine a more strictly optimal paper feed distance, it is desired to increase the number of paper feed distances and of stages of print duty.

Figure 10:
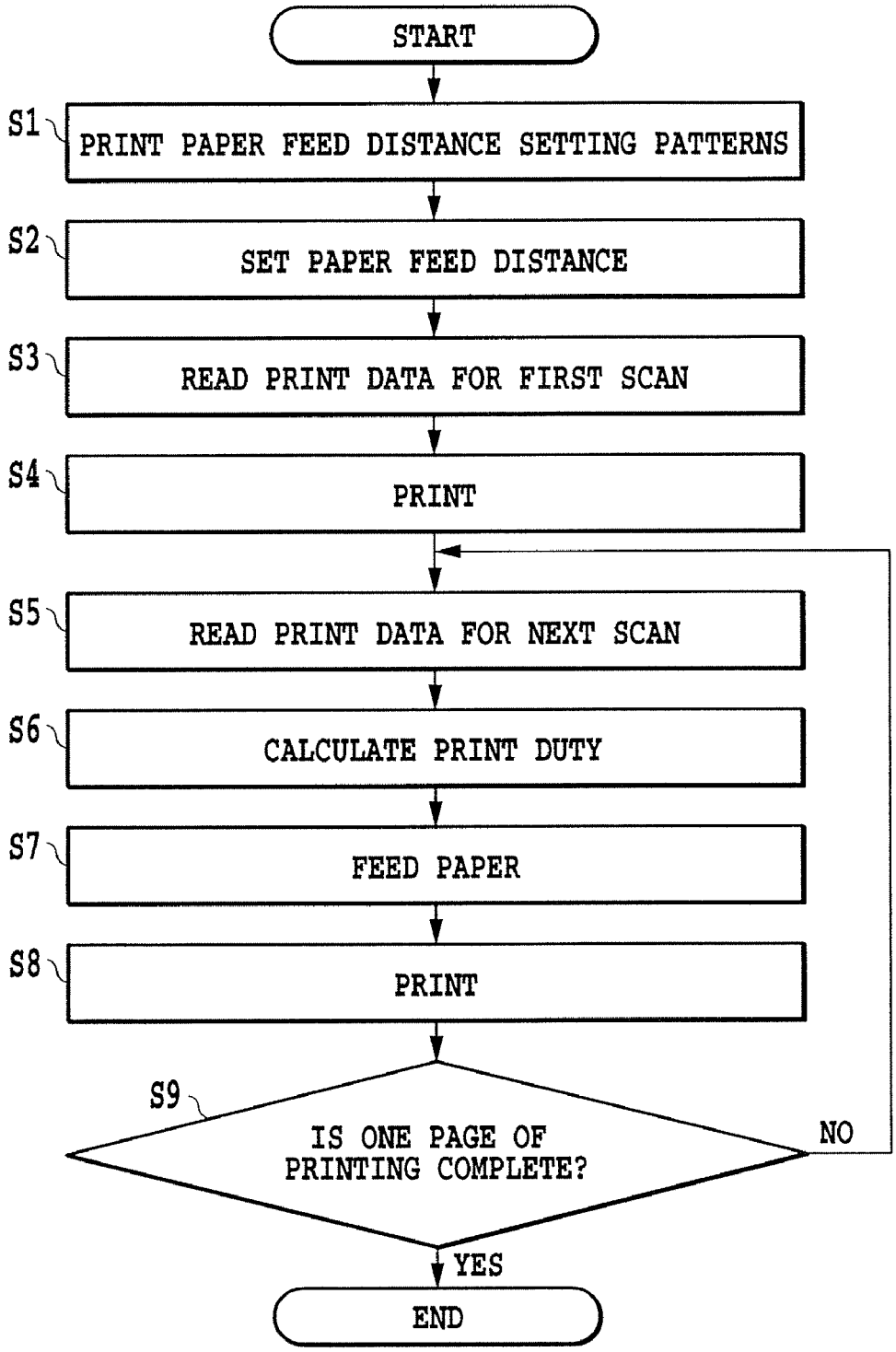
FIG. 10 is a flow chart showing an operation of the first embodiment of this invention.

FIG. 10 is a flow chart showing a sequence of steps from the paper feed distance setting to the printing.

First, paper feed distance setting patterns, such as shown in FIG. 9, are printed (step S1). Based on the printed result, a paper feed distance is set for each print duty (step S2) Next, 1-scan binary print data of an image to be printed first is read in (step S3) and the image for one scan is printed (step S4). Then, 1-scan binary print data of an image to be printed next is read in (step S5). Based on the print data thus read in, the number of dots to be formed in that one scan is counted. Using the count value, an average print duty in one scan is determined (step S6). Then, according to the paper feed distance set in step S2, the print medium is fed a distance corresponding to the average print duty in one scan (step S7). After this, the image of that one scan is printed (step S8). The operations in these steps S5, S6, S7, S8 are repeated until the printing for one page is finished (step S9).

By adjusting the paper feed distance according to the average is print duty as described above, it is possible to make a boundary line less noticeable even in the 1-pass printing and thereby form an image of satisfactory quality. Further, no image degradation due to a reduced paper feed distance has been observed even if the paper feed distance is set 20 μm shorter than the length of the print head 1 of L.

If the value of average print duty does not match any one stage of print duty used in the patterns of FIG. 9, a paper feed distance set for that stage of print duty which is closest to the average print duty is used. Considering the relation between multiple stages of print duty such as shown in FIG. 9 and a paper feed distance set for each stage of print duty, a paper feed distance corresponding to the average print duty different from any of the multiple stages of print duty may be calculated and used as an actual paper feed distance. In that case, the multiple stages of print duty, such as shown in FIG. 9, may be related with a paper feed distance set for each stage of print duty in a linear or curved line fashion to determine a paper feed distance that corresponds to the continuously changing average print duty.

The average print duty may cover a whole 1-scan print area as in this example or only that area in the whole 1-scan print area which is printed by end nozzles. With this arrangement, it is possible to better adjust the paper feed distance by effectively using the average print duty in the boundary portion P.

With the printing operation controlled by setting the paper feed distance as described above, in the example of FIG. 3 the positions of dots in the boundary portion (P) between the preceding scan (first scan) and the subsequent scan performed after the print medium has been fed a set distance (second scan) are changed in the paper feed direction. Therefore, if dots ejected from the end nozzles of the nozzle column should land on positions deviated from the intended positions, the positional relation between the dots formed by the two successive scans can be properly adjusted, thus reducing possible degradations of a printed image quality.

Second Embodiment

In the first embodiment the paper feed distance is adjusted based on the average print duty for each scan. In this example, the paper feed distance is adjusted by calculating an average value of the average print duties of two adjoining scans and basing its adjustment on the calculated average value.

Figure 11:
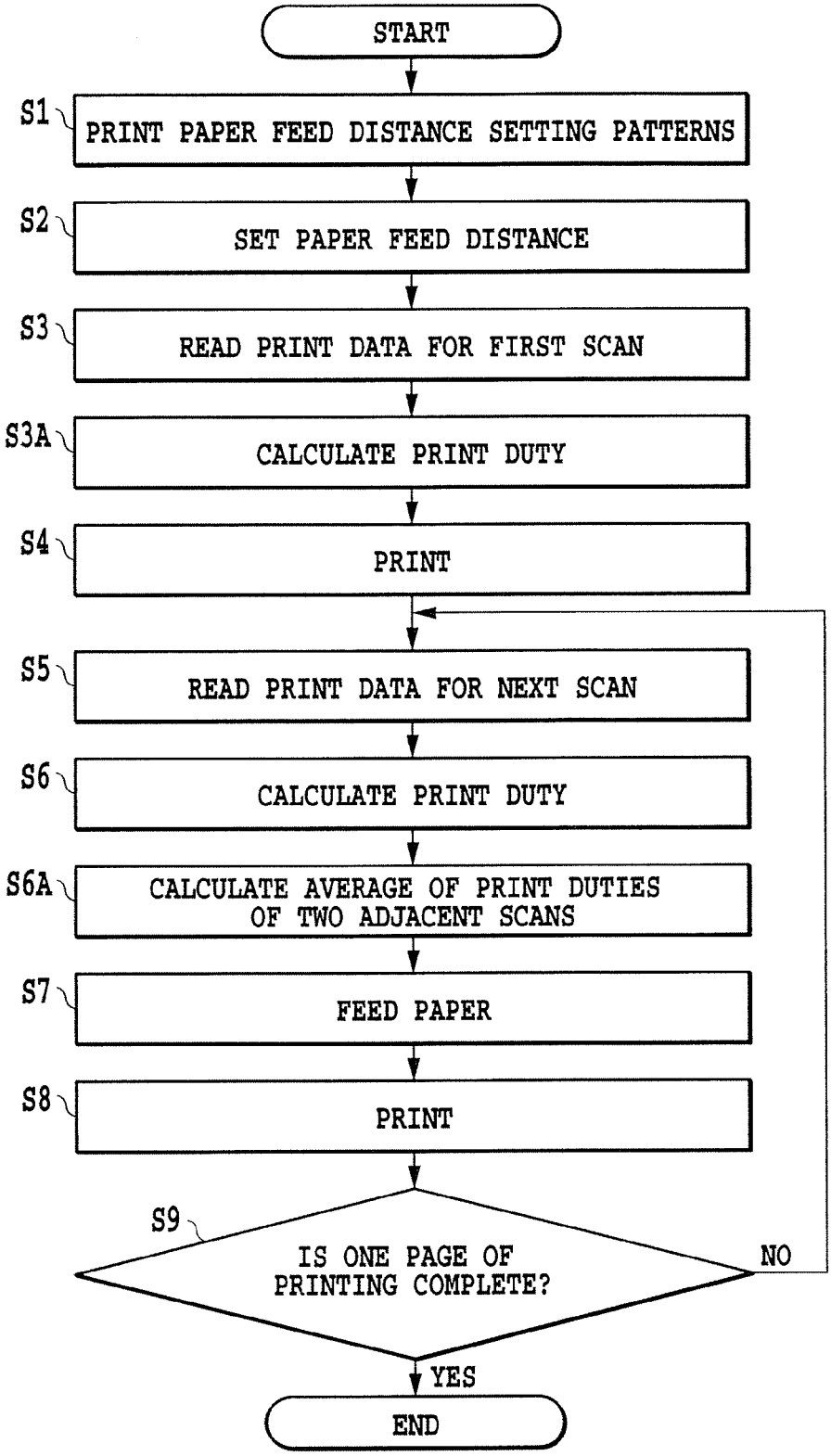
FIG. 11 is a flow chart showing an operation of a second embodiment of this invention.

FIG. 11 is a flow chart showing operations performed by the second embodiment of this invention and which has steps S3A, S6A added to the flow chart of FIG. 10. Step S3A checks print data of the first scan and counts the number of dots to be formed in that one scan to determine an average print duty in the first scan. Step S6A calculates an average value of the average print duties of the two successive scans. If step S6 calculates an average print duty of a second scan counting from the first scan, step S6A calculates an average of the two average print duties obtained in step S3A and step S6. If step S6 calculates an average print duty of the third scan counting from the first scan, step S6A calculates an average of the last two average print duties obtained as a result of the repetitive execution of step S6. Step S7 feeds the print medium a distance that corresponds to the average of the two successive average print duties obtained as described above.

In this embodiment, since the average print duty of each of two successive scans is considered in adjusting the paper feed distance, boundary lines can be made even less noticeable, producing a further improvement in the image quality.

Further, the average print duty may cover the entire print area of one scan as in this example or only that area in the entire 1-scan print area which is printed by end nozzles. With this arrangement, it is possible to better adjust the paper feed distance by effectively using the average print duty in the boundary portion P.

Third Embodiment

Figure 12:
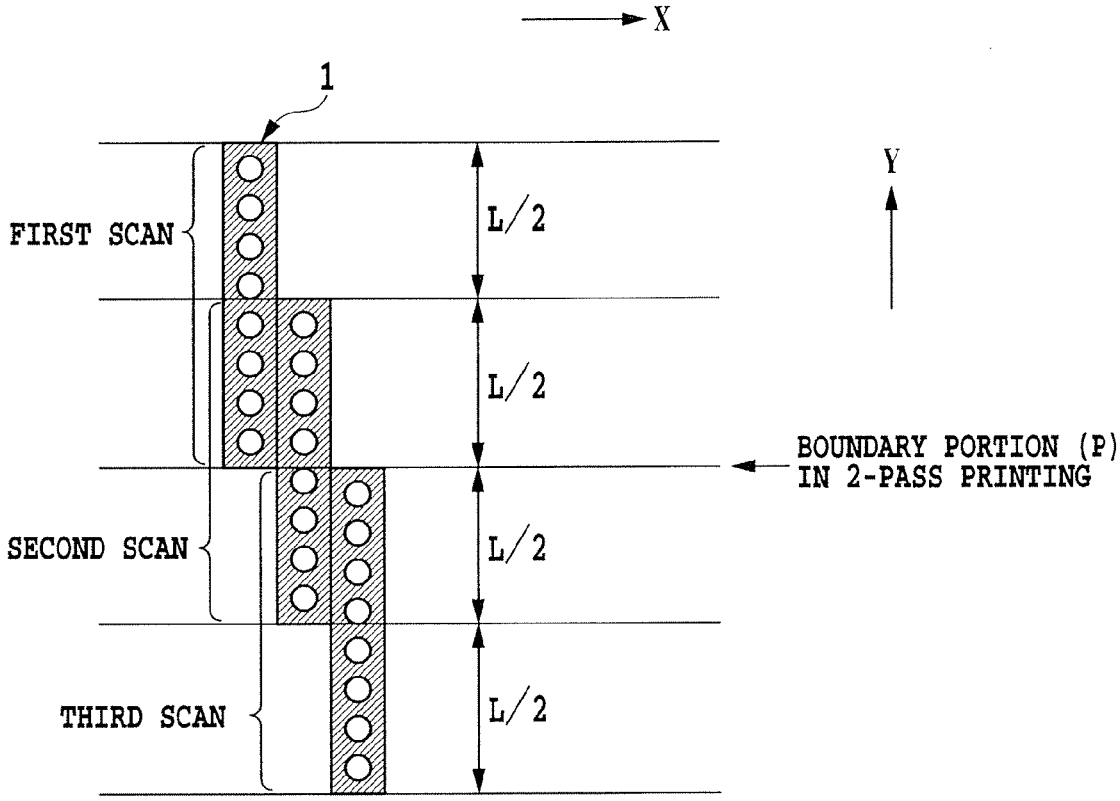
FIG. 12 is an explanatory diagram showing a relation between a 2-pass printing and boundary portions.

In this example, a multipass printing is performed by setting a paper feed distance for each page. FIG. 12 is an explanatory diagram showing the process of printing an image by a 2-pass printing. In the 2-pass printing, the normal paper feed distance is one-half the length of the print head 1 of L (i.e., L/2) and the boundary portion P occurs at a boundary between a first scan and a third scan.

In this example also, by setting a paper feed distance to control the printing operation, the positions of dots in the boundary portion (P) between the preceding scan (first scan) and the subsequent scan performed after the print medium has been fed a set distance (third scan) are changed in the paper feed direction.

Figure 13:
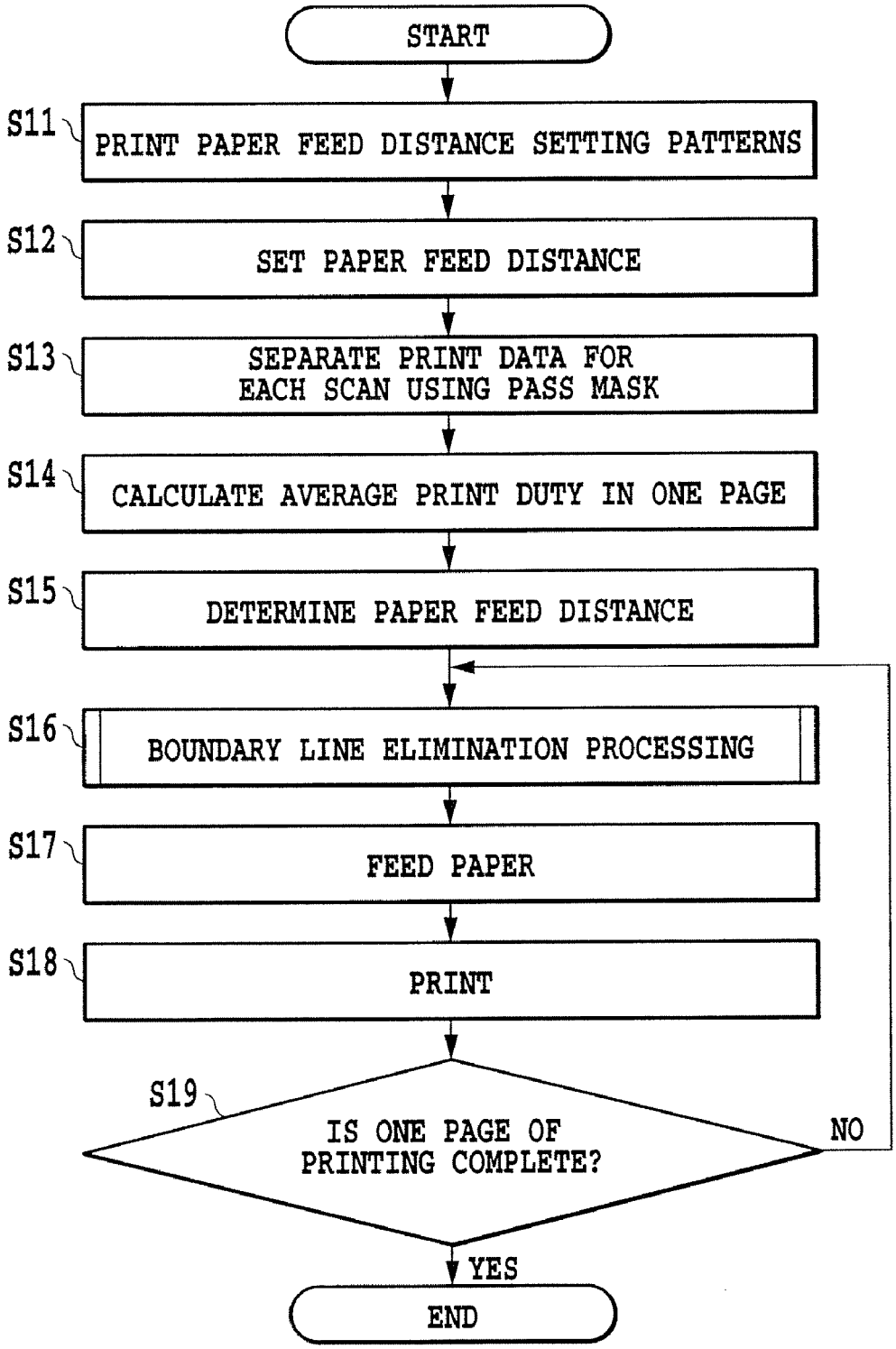
FIG. 13 is a flow chart showing an operation of a third embodiment of this invention.

FIG. 13 is a flow chart showing printing operations performed in this example.

In FIG. 13, first, paper feed distance setting patterns, such as shown in FIG. 9 of the preceding embodiment, are printed (step S11). Based on the printed result, a paper feed distance is set for each print duty (step S12). Next, multi-value print data is transformed into binary data and the binary print data in one page is separated into individual scans (step S13) by using a pass mask. In the case of print data for a color image, the print data is color-separated and transformed into binary data for each ink color. Next, based on the print data thus obtained, the number of dots to be formed in one page is counted. Using the count value, an average print duty in that one page is calculated (step S14). Then, according to the paper feed distance set in step S12, a paper feed distance corresponding to the average print duty is determined (step S15). When a plurality of different inks (e.g., cyan, magenta, yellow and black inks) are used, an average print duty is calculated for each ink color and a paper feed distance is determined which corresponds to the highest of these average print duties.

Figure 14:
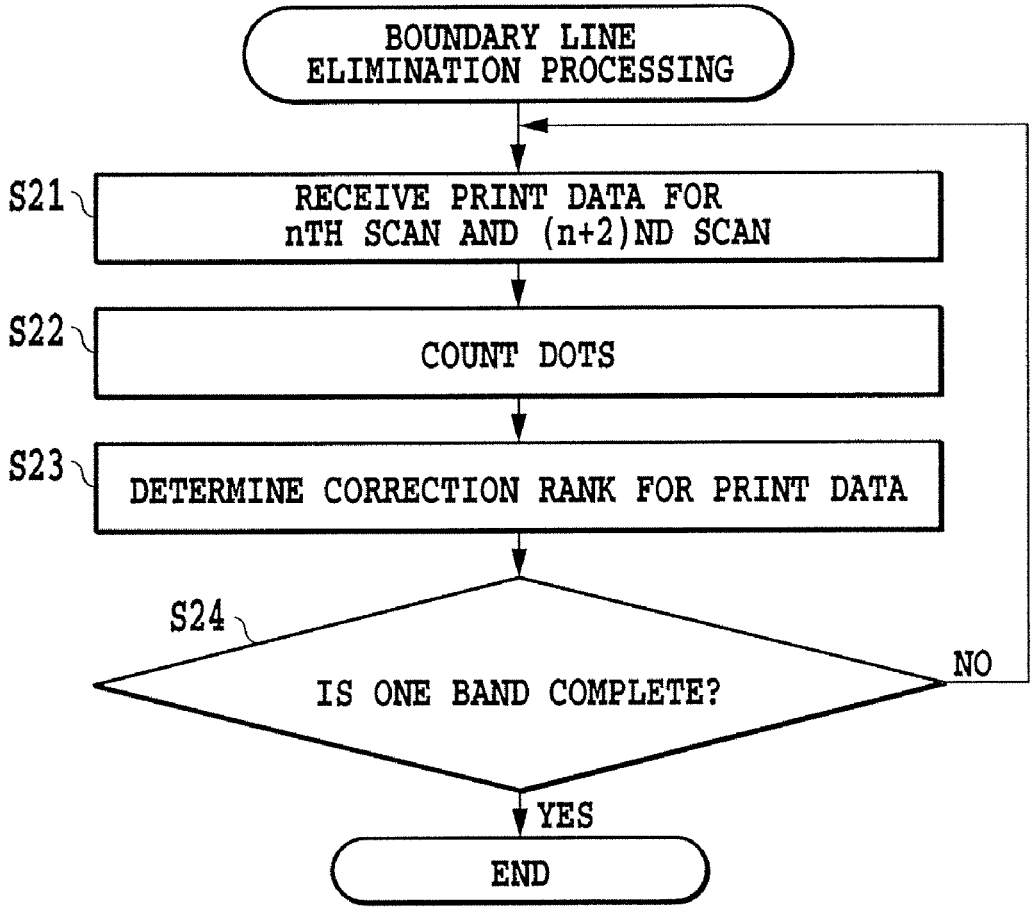
FIG. 14 is a flow chart showing boundary processing of FIG. 13.

After the paper feed distance has been determined as described above, boundary line elimination processing is performed as shown in FIG. 14.

Figure 15:
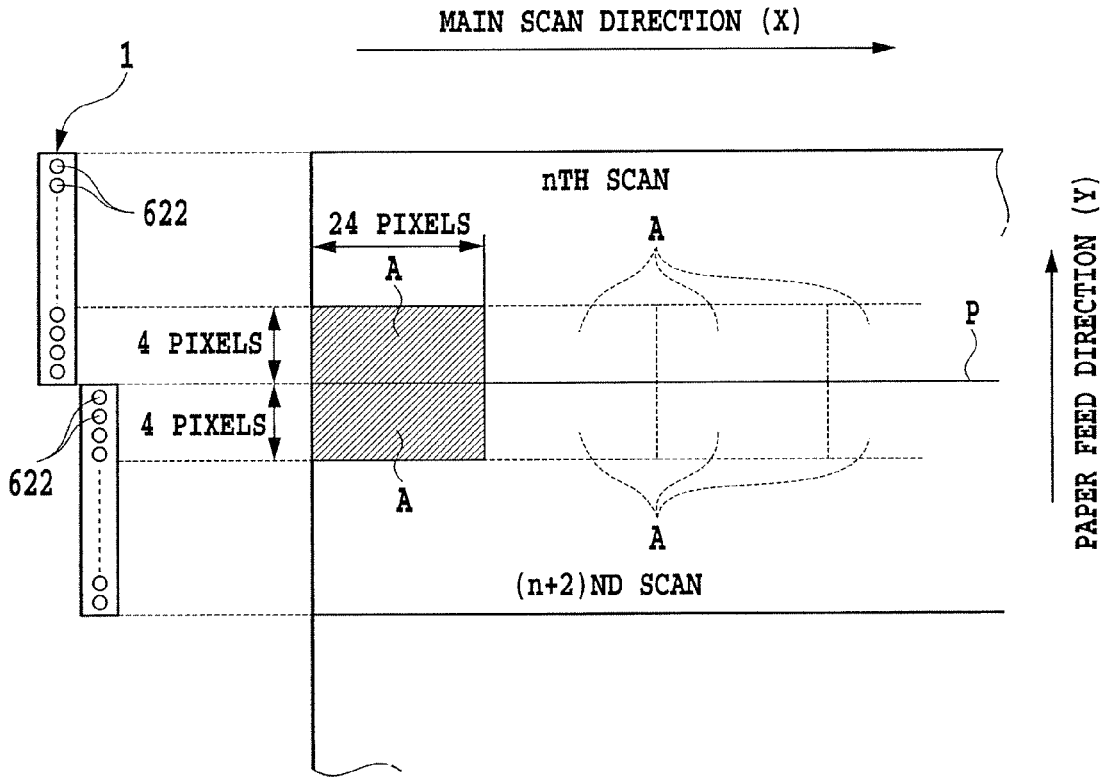
FIG. 15 is an explanatory diagram showing dot count processing of FIG. 14.

First, print data for an nth scan and an (n+2)nd scan making up the boundary portion P in the 2-pass printing is received (step S21). Then, based on the print data received, the number of dots to be formed in a predetermined dot count area is counted (step S22). The dot count value is equivalent to a print duty in the predetermined dot count area. FIG. 15 is an explanatory diagram showing a dot count area A. The dot count area A in this example is one of a plurality of 4×24-pixel print areas adjoining the boundary portion P and, in the nth scan and the (n+2)nd scan, the number of dots in the associated dot count areas A is counted.

Figure 16:
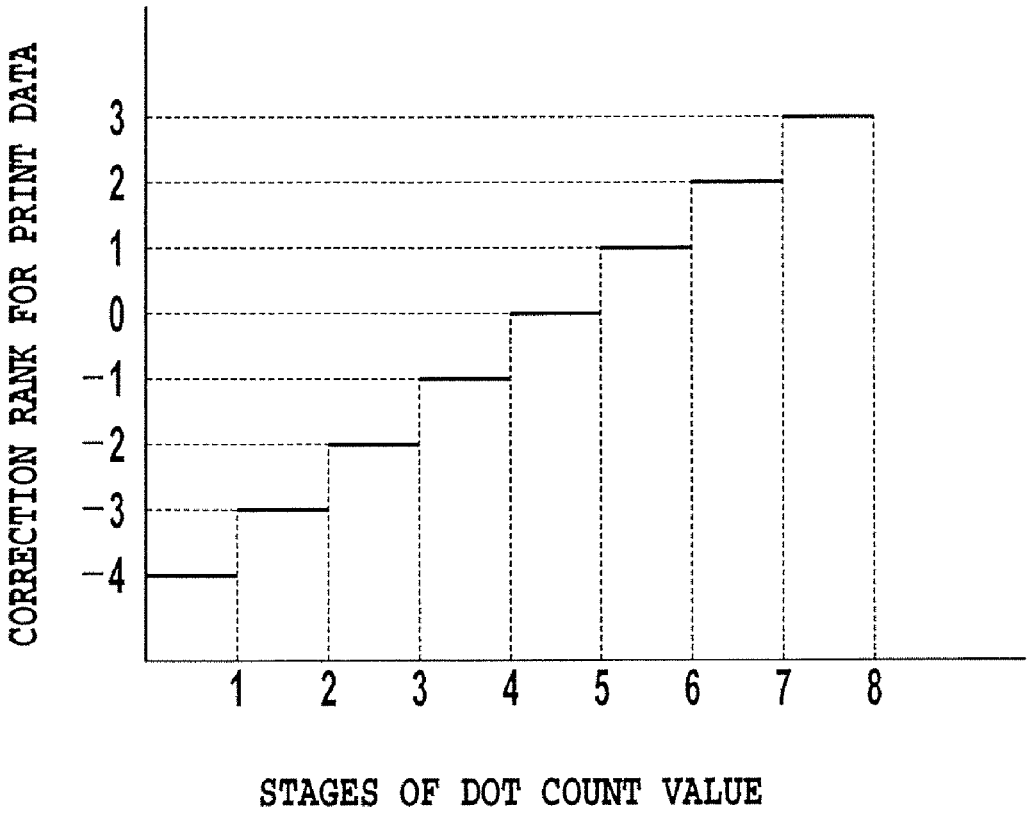
FIG. 16 is an explanatory diagram showing correction rank decision processing of FIG. 14.

Next, based on the dot count value for each dot count area A, a correction rank for the respective dot count areas A is determined (step S23). A relation between the dot count value and the correction rank is set beforehand for each paper feed distance that is determined in step S15 of FIG. 13. For example, let us consider a case in which the paper feed distance is 3 μm longer than the normal 2-pass printing paper feed distance of L/2 (i.e., +3 μm). The dot count value is divided into eight stages, as shown in FIG. 16, and the eight stages are matched to eight correction ranks (−4, −3, −2, −1, 0, +1, +2, +3). When the correction rank is in the range of −4 to −1, a correction is made to thi n the print data so as to reduce the number of dots to be formed in the associated dot count area A. For example, the print data is thinned to reduce the number of dots in the dot count area A by 4 when the correction rank is −4, by 3 when the correction rank is −3, by 2 when the correction rank is −2, and by 1 when the correction rank is −1. When the correction rank is 0, no correction is made of the print data. Further, when the correction rank is in the range of 1 to 3, the print data is corrected to increase the number of dots to be formed in the associated dot count area A. For example, the print data is corrected to add one dot when the correction rank is 1, two dots when the correction rank is 2, and three dots when the correction rank is 3.

Figure 17:
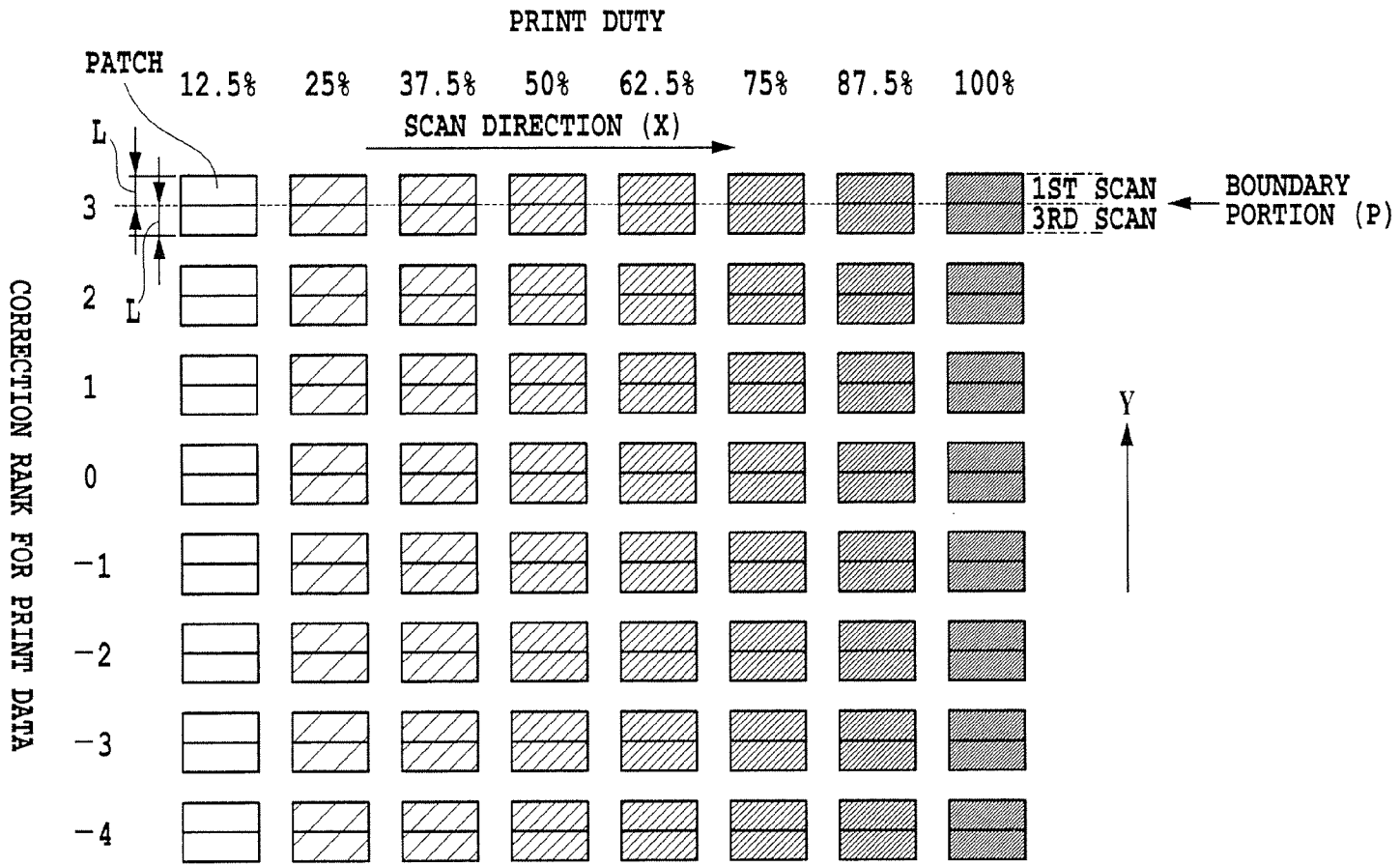
FIG. 17 is an explanatory diagram showing a correction rank setting pattern printed in the third embodiment of this invention.

The relation between the dot count value and the correction rank can be set by printing patches as shown in FIG. 17 when a printing apparatus is manufactured or shipped. In FIG. 17, a plurality of patches equal in number to the multiple stages of print duty are printed and, based on the printed result, the relation between the dot count value and the correction rank is optimally set. The print pattern made up of a plurality of patches such as shown in FIG. 17 is printed for each paper feed distance that is determined by step S15 of FIG. 13.

In this example, as shown in FIG. 17, eight stages of print duty (12.5, 25, 37.5, 50, 62.5, 75, 87.5, 100%) are provided for the dot count areas A so that they match the eight stages of count value in FIG. 16, and eight correction ranks are provided so they match the correction ranks of FIG. 16. Therefore, a total of 64 (=8×8) patches are printed. The eight patches arrayed horizontally in FIG. 17 are printed in an nth scan and an (n+2)nd scan using the print data corrected by the corresponding correction rank. For example, eight patches arrayed horizontally in the top row in the figure are printed with eight stages of print duty using the print data that is corrected by the correction rank 3. That is, an upper half of these patches is first printed with eight stages of print duty in a first scan (nth scan). Then, a lower half of these patches is printed with the eight stages of print duty in a third scan ((n+2)nd scan). As for the paper feed distance used in the above printing, when for example the relation between the dot count value and the correction rank is set for the paper feed distance (+3 μm) of FIG. 16, the print medium feeding is adjusted according to the corresponding paper feed distance (+3 μm).

From the printed result of these patches, a correction rank is set for each print duty which makes a boundary line in the boundary portion P between the first scan and the third scan least noticeable. This correction rank for each print duty is set for each paper feed distance determined by step S15 of FIG. 13. When print head manufacturing variations and printing apparatus paper feed accuracy variations are considered, printing the patterns as shown in FIG. 17 in every printing apparatus is very effective in setting an optimal correction rank for each printing apparatus. Further, since the boundary line appears differently depending on the kind of print medium, it is preferred that the patterns such as shown in FIG. 17 are printed on a desired print medium. To realize a more strictly optimal print data correction, it is preferable to increase the number of stages of correction rank.

Figure 18:
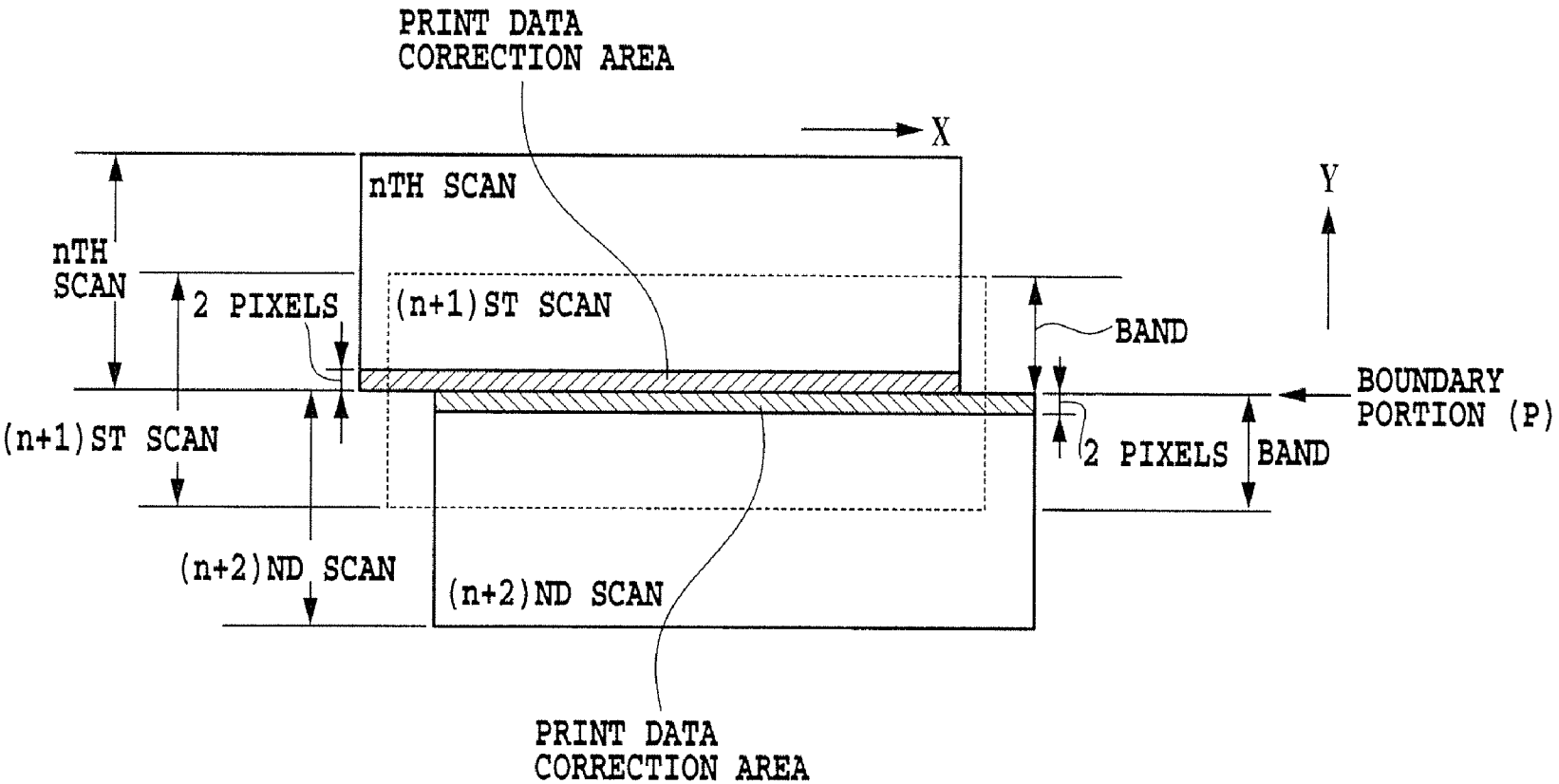
FIG. 18 is an explanatory diagram showing print data correction processing of FIG. 14.

Based on the preset relation between the dot count value and the correction rank, the print data is corrected for each dot count area A according to the correction rank determined by step S23 of FIG. 14. The correction area of the print data may be the same as the dot count area A or an area narrower in width than the dot count area A to enhance a data processing speed. FIG. 18 shows an example where the print data correction area is 2 pixels wide. In this case the correction area is made up of a plurality of 2×12-pixel areas adjoining the boundary portion P. This correction process is repeated until one band is complete (step S24). As a result, print data in the 2-pixel-wide area over the entire print range in the main scan direction is corrected according to the correction rank.

After the print data has been corrected by the boundary line elimination processing of FIG. 14, the processing returns to step S17 of FIG. 13 where it feeds the print medium a distance that was determined by step S15, before printing an image (step S18). This sequence of steps S16, S17, S18 Is repeated until the printing of one page is complete (step S19).

When a plurality of different inks (e.g., cyan, magenta, yellow and black inks) are used, the correction rank is determined for each ink color to correct the print data.

As described above, the print data correction process involves determining an equally applicable paper feed distance between successive scans in one page according to the print duty in that page, determining an optimal correction rank based on a combination of the paper feed distance and the print duty for the areas adjoining the boundary portion P, and correcting the print data according to the correction rank. The correction of print data not only thins print data but also adds dots to it. This process therefore can make a boundary line less noticeable by correcting the print data according to the print density in the boundary portion P and subtracting or adding dots to and from the print data in the boundary portion P. This ensures that a quality image with no apparent boundary lines can be formed also in the 2-pass printing.

It is also possible to correct the print data to change the volume of each ink droplet. What is important is that the area covered by ink in the boundary portion can be increased or decreased. The paper feed distance may be determined by taking an average print duty of each of two adjacent scans into account, as in the first and second embodiment. Further, the average print duty may be one for that area in the entire print area of each scan which is printed by end nozzles.

Further, when a plurality of different inks (e.g., cyan, magenta, yellow and black inks) are used, a print pattern consisting of a plurality of patches such as shown in FIG. 17 may be printed for each ink color and an optimum correction rank may be determined for each ink color.

Other Embodiments

This invention is not limited to 1-pass or 2-pass printing, which is effective in increasing the printing speed, but can also be applied to other multi-pass printing methods such as 3- or 4-pass printing.

Further, in 2- or higher-pass printing, the paper feed distance may be determined by considering an average print duty of each of two adjacent scans, as in the first and second embodiment. The average print duty may also be one for that area in the entire print area of each scan which is printed by end nozzles. What is needed is that it must be possible to set the print medium feed distance (paper feed distance) according to the print density of an image. In that case, the lower the print duty, the smaller the print medium feed distance can be set.

It is also possible to set the print medium feed distance (paper feed distance) according to the kind of print medium. In that case, the feed distance is increased as the tendency for the ink used to spread on the print medium becomes more prominent.

When the print medium feed distance is set according to the amount of deviation of landing positions of ink droplets ejected from end nozzles of the print head, the feed distance is made to increase with an increasing ink dot landing position deviation toward the center of the nozzle column.

(Others)

The present invention produces excellent effects in the ink jet printing system, particularly in print heads and printing apparatus utilizing thermal energy for ink ejection.

As for the representative construction and working principle, it is preferable to use the basic principle disclosed in U.S. Pat. Nos. 4,723,129 and 4,740,796. This system can be applied to either the so-called on-demand type or continuous type. In the case of the on-demand type, in particular, electrothermal transducers installed in a sheet or ink paths holding ink are applied at least one drive signal, that matches the print data, to cause a rapid temperature rise in excess of a nucleate boiling. The electrothermal transducers generate a thermal energy enough to produce a film boiling on a heat application surface in the print head, thereby forming bubbles in ink that match the drive signals with a one-to-one correspondence. As they expand and contract, the bubbles eject ink from the nozzles, forming at least one ink droplet. It is preferred that the drive signal be formed in a pulse shape because the pulse signal can cause the bubbles to instantly and properly expand and contract, realizing a responsive ejection of ink. Preferred pulse-shaped drive signals include those disclosed in U.S. Pat. Nos. 4,463,359 and 4,345,262. An even more excellent printing can be realized if conditions, disclosed in U.S. Pat. No. 4,313,124 concerning a temperature increase rate on the heat application surface, are adopted.

As for the construction of the print head, in addition to the construction described in the above patent specifications in which nozzles, ink paths and electrothermal transducers are combined (to form linear or right-angle flow paths), this invention also includes a construction in which the heat application portion is arranged in a bent area (U.S. Pat. Nos. 4,558,333 and 4,459,600). Further, this invention can also be effectively applied to a construction in which a slit is formed as an ejection portion common to a plurality of electrothermal transducers (Japanese Patent Application Laid-open No. 59-123670 (1984)) and a construction in which an opening for absorbing a pressure wave of thermal energy is formed according to the ejection portion (Japanese Patent Application Laid-open No. 59-138461 (1984)).

Furthermore, the ink jet printing apparatus of this invention may be used not only as an image output terminal for information processing devices such as computers, but also as a copying machine in combination with a reader or as a facsimile machine with transmission and reception functions.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2004-107752 filed Mar. 31, 2004, which is hereby incorporated by reference herein.

What is claimed is:

1. An ink jet printing apparatus for printing an image on a print medium by using an inkjet head having a plurality of ejection openings arrayed in a predetermined direction, the ink jet printing apparatus comprising:

moving means for performing a movement of the inkjet head relative to the print medium in a first direction crossing the predetermined direction;

feeding means for performing a feeding operation of the print medium in a second direction crossing the first direction; and setting means for setting a feed distance for each feeding operation which is performed between a previous movement and a subsequent movement of the inkjet head, wherein the setting means sets each feed distance on the basis of a print duty in a previous print area which is printable with the previous movement of the inkjet head and a print duty in a subsequent print area, adjacent to the previous print area in the second direction, which is printable with the subsequent movement of the inkjet head, the feed distance being selected from among a plurality of feed distances which are changed from a basic feed distance, the basic feed distance being determined based on the number of scans of the inkjet print head that is required to complete the printing of the same area on the print medium, and wherein the feeding distance after each previous movement of the inkjet head is changeable.

2. An ink jet printing method for printing an image on a print medium by using an inkjet head having a plurality of ejection openings arrayed in a predetermined direction, the ink jet printing method comprising the steps of:

performing a moving operation for moving the inkjet print head in a first direction crossing the predetermined direction;

performing a feeding operation for feeding the print medium in a second direction crossing the first direction;

printing the image on the print medium by repeating the moving operation and the feeding operation; and setting a feed distance for each feeding operation which is performed between a previous moving operation and a subsequent moving operation, wherein, in the feed distance setting step, each feed distance is set on the basis of a print duty in a previous print area which is printable with the previous moving operation and a print duty in a subsequent print area, adjacent to the previous print area in the second direction, which is printable with the subsequent moving operation, the feed distance being selected from among a plurality of feed distances which are changed from a basic feed distance, the basic feed distance being determined based on the number of scans of the inkjet print head that is required to complete the printing of the same area on the print medium, and wherein the feeding distance after each previous moving operation is changeable.

* * * * *